United States Patent [19]

Nobile

[11] Patent Number: 4,905,590

[45] Date of Patent: Mar. 6, 1990

[54] MAILING MACHINE INCLUDING DRIVING MEANS CIRCUIT

[75] Inventor: John R. Nobile, Fairfield, Conn.

[73] Assignee: Pitney Bowes Inc., Stamford, Conn.

[21] Appl. No.: 307,559

[22] Filed: Feb. 8, 1989

[51] Int. Cl.[4] ..... B41L 47/46

[52] U.S. Cl. ..... 101/91; 101/219; 101/234; 271/227; 271/236; 271/265; 271/246

[58] Field of Search ..... 101/232–239, 101/216, 91, 219, 142, 242; 271/245, 246, 236, 265, 258, 259, 227

[56] References Cited

U.S. PATENT DOCUMENTS

| | | | |
|---|---|---|---|
| 4,002,117 | 1/1977 | Ritzerfeld | 101/91 |
| 4,037,535 | 7/1977 | Lehmann et al. | 101/233 |

FOREIGN PATENT DOCUMENTS

| | | | |
|---|---|---|---|
| 918640 | 7/1949 | Fed. Rep. of Germany | 101/233 |
| 4683 | of 1912 | United Kingdom | 101/233 |
| 488217 | 7/1938 | United Kingdom | 101/233 |
| 576267 | 3/1946 | United Kingdom | 101/233 |

*Primary Examiner*—Eugene H. Eickholt

*Attorney, Agent, or Firm*—Donald P. Walker; Melvin J. Scolnick; David E. Pitchenik

[57] ABSTRACT

In a mailing machine including a postage meter, wherein the postage meter includes rotary printing structure for printing indicia on a sheet fed to the machine, and the machine includes apparatus for driving the printing structure, wherein the driving apparatus includes a drive gear, the driving apparatus includes a locking member movable into and out of locking engagement with the drive gear, the driving apparatus includes an actuating member for moving the locking member, and wherein the machine includes trip structure for sensing a sheet fed to the machine, an improvement comprising: a source of supply of d.c. power; a first circuit connected across the power supply and including a solenoid and a trip switch actuatable for energizing the solenoid; a second circuit connected across the power supply and including a d.c. motor and a motor switch actuatable for energizing and deenergizing the motor; and the trip switch actuated in response to the trip structure sensing a sheet fed to the machine, and the driving apparatus causing the actuating member to move the locking member out of locking engagement with the drive gear and actuate the motor switch for energizing the motor to drive the drive gear when the solenoid is energized.

9 Claims, 7 Drawing Sheets

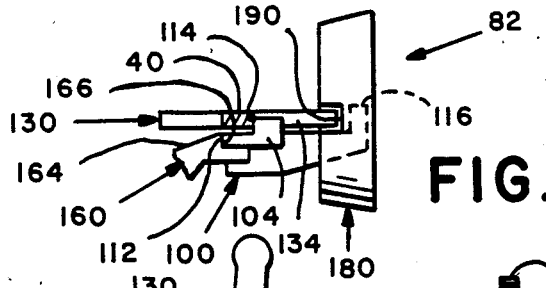
FIG. 5B
FIG. 5A
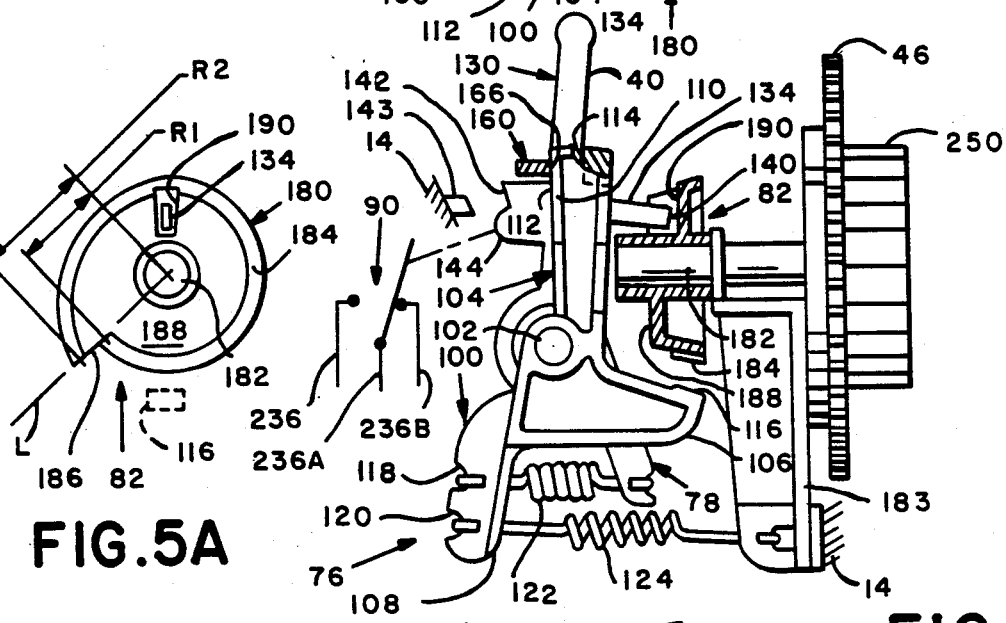
FIG. 5
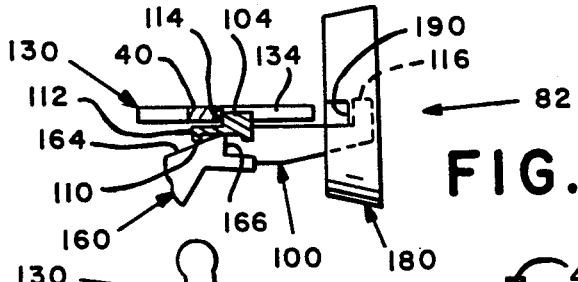
FIG. 6B
FIG. 6A
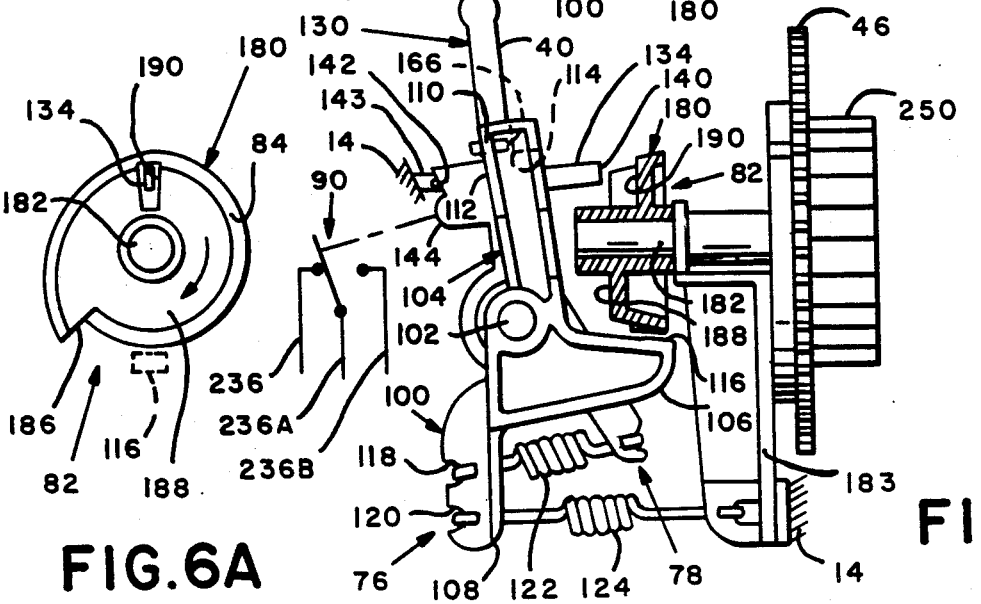
FIG. 6

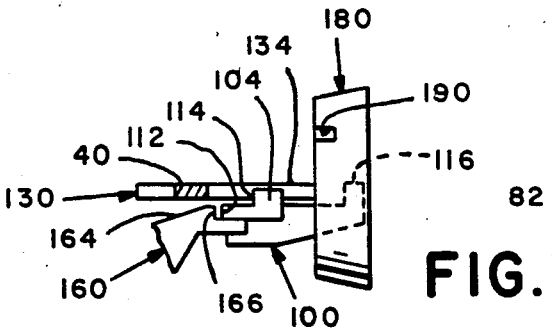
FIG.7B
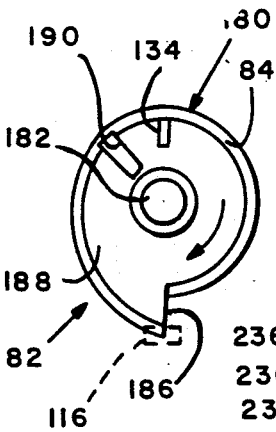
FIG.7A
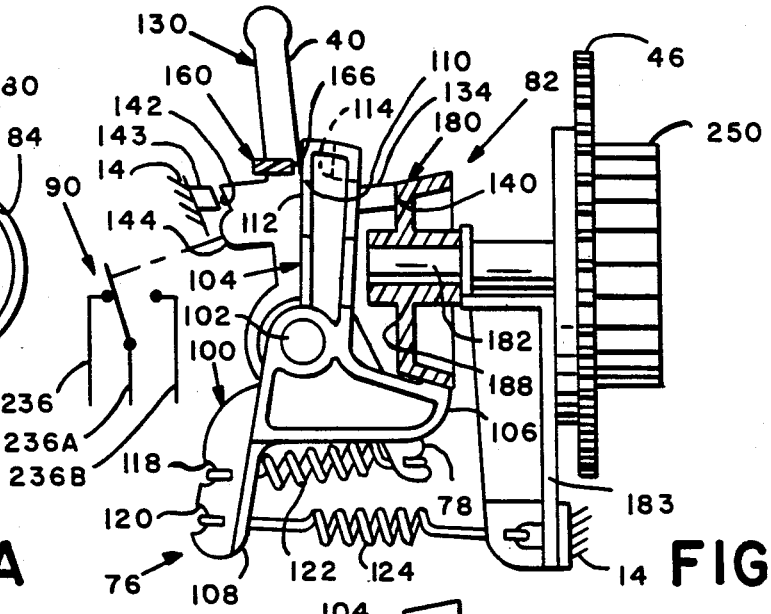
FIG.7
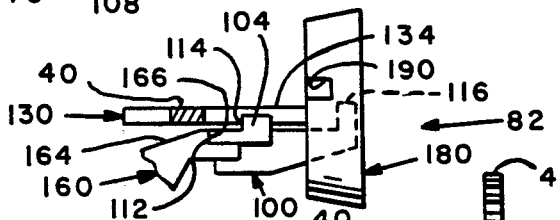
FIG.8B
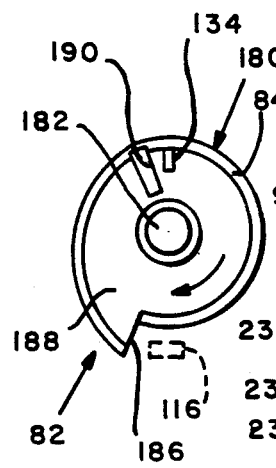
FIG.8A
FIG.8

MAILING MACHINE INCLUDING DRIVING MEANS CIRCUIT

BACKGROUND OF THE INVENTION

The present invention is generally concerned with a drive system for mailing machines including driving means for controlling rotary printing structures, and more particularly with a drive system including a control circuit therefor.

As shown in U.S. Pat. No. 2,934,009, issued Apr. 26, 1962, Bach, et al. and assigned to the assignee of the present invention, there is described a mailing machine which includes a postage meter and a base on which the postage meter is removably mounted. The postage meter includes a rotary printing drum and a drive gear therefor which are mounted on a common shaft and normally located in a home position. The base includes a drive mechanism having an output gear which is disposed in meshing engagement with the drum drive gear when the postage meter is mounted on the base. The drive mechanism includes a single revolution clutch, having a helical spring, for rotating the drum from the home position and into engagement with a letter fed to the drum. Each revolution of the clutch, and thus of the drum, is initiated by a letter engaging a trip lever to release the helical spring. In the course of each drum revolution, the drum prints a postage value on the letter while feeding the same downstream beneath the drum as the drum returns to its home position. Thus the drive mechanism intermittently operates the rotary printing drum.

Although the single revolution clutch structure has served as the workhorse of the mailing machine industry for many years, it has long been recognized that it is a complex mechanism which is relatively expensive to construct and maintain, tends to be unreliable in high volume applications, and is noisy and thus irritating to customers.

Accordingly, an object of the invention is to replace the mailing machine drive mechanism of the prior art with a simplified, highly reliable and quietly operating mailing machine drive system including a circuit for controlling operation of the drive system.

SUMMARY OF THE INVENTION

In a mailing machine including a postage meter, wherein the postage meter includes rotary printing means for printing indicia on a sheet fed to the machine, and the machine includes means for driving the printing means, wherein the driving means includes a drive gear, the driving means includes a locking member movable into and out of locking engagement with the drive gear, the driving means includes an actuating member for moving the locking member, and wherein the machine includes trip means for sensing a sheet fed to the machine, an improvement comprising: a source of supply of d.c. power; first circuit means connected across the power supply and including a solenoid and a trip switch actuatable for energizing the solenoid; second circuit means connected across the power supply and including a d.c. motor and a motor switch actuatable for energizing and deenergizing the motor; and the trip switch actuated in response to the trip means sensing a sheet fed to the machine, and the driving means causing the actuating member to move the locking member out of locking engagement with the drive gear and actuate the motor switch for energizing the motor to drive the drive gear when the solenoid is energized.

BRIEF DESCRIPTION OF THE DRAWINGS

As shown in the drawings wherein like reference numerals designate like or corresponding parts throughout the several views:

FIG. 5 is a plan view of drive mechanism of FIG. 2 shown in its normal or at-ready mode of operation;

FIG. 5A is a side view of the rotary cam of the drive mechanism of FIG. 5;

FIG. 5B is a partial top view of the drive mechanism of FIG. 5;

FIG. 6 is a plan view, similar to FIG. 5, showing the drive mechanism when the latching member thereof has been moved to its unlatching position to release the control member for carrying the actuating member out of locking relationship with the cam and causing the actuating member to actuate the motor switch;

FIG. 6A is a side view of the rotary cam of the drive mechanism of FIG. 6;

FIG. 6B is a partial top view of the drive mechanism of FIG. 6

FIG. 7 is a plan view, similar to FIG. 6, showing the drive mechanism when the control member thereof has been partially pivoted by the rotary cam to permit the latching member to return to its latching position;

FIG. 7A is a side view of the rotary cam of the drive mechanism of FIG. 7;

FIG. 7B is a partial top view of the drive mechanism of FIG. 7;

FIG. 8 is a plan view, similar to FIG. 7, showing the drive mechanism when the control member has been fully pivoted by the rotary cam, released thereby and re-latched by the latching member;

FIG. 8A is a side view of the rotary cam of the drive mechanism of FIG. 8;

FIG. 8B is a partial top view of the drive mechanism of FIG. 8;

DESCRIPTION OF THE PREFERRED EMBODIMENTS

Figure 1:
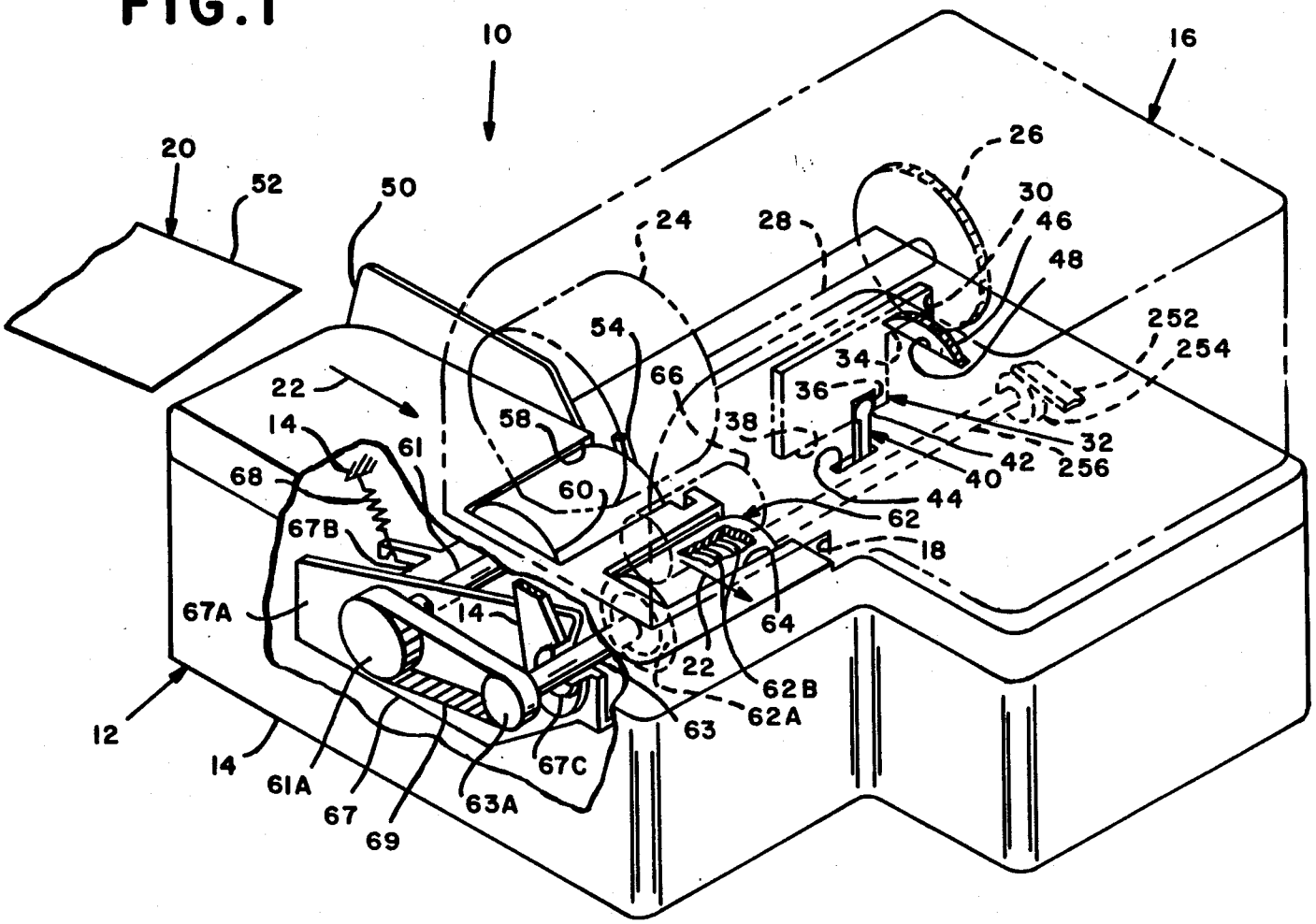
FIG. 1 is a partially phantom, perspective, view of a prior art mailing machine, including a postage meter removably mounted on a base, showing apparatus according to the invention for mounting and driving the impression roller and ejection roller.

As shown in FIG. 1, the apparatus in which the invention may be incorporated generally includes a mailing machine 10 which includes a base 12, having a housing 14, and a postage meter 16 which is removably mounted on the base 12. When mounted on the base 12, the postage meter 16 forms therewith a slot 18 through which sheets 20, including mailpieces such as letters, envelopes, cards or other sheet-like materials, may be fed in a downstream path of travel 22.

The postage meter 16 (FIG. 1) includes rotary printing structure including a postage printing drum 24 and a drive gear 26 therefor. The drum 24 and drive gear 26 are spaced apart from one another and mounted on a common drum drive shaft 28. The drum 24 is conventionally constructed and arranged for feeding the respective sheets 20 in the path of travel 22, which extends beneath the drum 24, and for printing postage data, registration data or other selected indicia on the upwardly disposed surface of each sheet 20. The drum drive gear 26 has a key slot 30 formed therein, which is located vertically beneath the drum drive shaft 28 when the postage meter drum 24 and drive gear 26 are located in their respective home positions. The postage meter 16 additionally includes a shutter bar 32, having an elongate key portion 34 which is transversely dimensioned to fit into the drive gear's key slot 30. The shutter bar 32 is conventionally reciprocably mounted within the meter 16 for movement toward and away from the drum drive gear 26, to permit moving the shutter bar's key portion 34 into and out of the key slot 30, under the control of the mailing machines base 10, when the drum drive gear 26 is located in its home position. To that end, the shutter bar 32 has a channel 36 formed thereinto from its lower surface 38, and, the mailing machine's base 12 includes a movable lever arm 40, having an arcuately-shaped upper end 42, which extends upwardly through an aperture 44 formed in the housing 14. When the meter 16 is mounted on the base 10, the lever arm's upper end 42 fits into the channel 36 in bearing engagement with the shutter bar 32 for reciprocally moving the bar 32, to and between one position, wherein shutter bar's key portion 34 is located in the drum drive gear's key slot 30, for preventing rotation of the drum drive gear 26, and another position wherein the key portion 34 is located out of the key slot 30, for permitting rotation of the drum drive gear 26. And, for driving the drum gear 26, the base 12 includes a drive system output gear 46 which extends upwardly through another housing aperture 48 and into meshing engagement with the drum gear 26.

The base 12 (FIG. 1) additionally includes sheet aligning structure including a registration fence 50 against which an edge 52 of a given sheet 20 may be urged when fed to the mailing machine 10. Further, the base 12 includes drive system trip structure for sensing sheets 20 fed to the machine 10, including a trip lever 54 which extends upwardly through another housing aperture 58 and into the path of travel 22 of each sheet 20 fed to the mailing machine 10. Moreover, the base 12 includes a conventional input feed roller 60, known in the art as an impression roller. The impression roller 60 is suitably secured to or integrally formed with a driven shaft 61. And the shaft 61 is resiliently connected to the housing 14, as hereinafter set forth in greater detail, for causing the roller 60 to extend upwardly through the housing aperture 58 and into the path of travel 22 for urging each sheet 20 into printing engagement with the drum 24 and cooperating therewith for feeding the sheets 20 through the machine 10.

For feeding sheets 20 (FIG. 1) from the mailing machine 10, the base 12 includes a conventional output feed roller 62, known in the art as an ejection roller. The roller 62 includes a cylindrically-shaped rim 62A and a coil spring 62B connecting the rim 62A to a hubbed, driven shaft 63. Thus the rim 62A is driven by the shaft 63 via the coil spring 62B. And the shaft 63 is rotatably connected to the housing 14, as hereinafter set forth in greater detail, for causing the roller 62 to extend upwardly through a further housing aperture 64 and into the path of travel 22. Moreover, the postage meter 16 includes a suitable idler roller 66 which is conventionally yieldably mounted, to accommodate mixed thickness batches of sheets 20, with its axis disposed parallel with the axis of the ejection roller 62, when the meter 16 is mounted on the base 14. As thus mounted, the idler roller 66 extends downwardly into the path of travel 22. Preferably, the idler roller 66 is also conventionally movably mounted for adjusting vertical spacing thereof from the ejection roller 62, to accommodate feeding a given batch of relatively thick sheets 20, such as a batch of envelopes which are each stuffed with a letter and inserts. Thus, the rollers, 62 and 66, are constructed and arranged to accommodate feeding sheets 20 of mixed thickness therebetween and in the path of travel 22 from the machine 10.

According to the invention, the base 12 (FIG. 1), and thus the mailing machine 10, includes an elongate impression roller carriage 67 which includes a pair of parallel-spaced side walls 67A, one of which is shown, and a lower wall 67B which extends between and is suitably secured to or integrally formed with the side walls 67A. The carriage 67 generally horizontally extends from the ejection roller shaft 63, and beneath and in supporting relationship with the impression roller shaft 61. More particularly, one end of each of the carriage side walls 67A is preferably pivotably attached to the housing 14 so as to define parallel-spaced arcuately-shaped bearing surfaces 67C within which the ejection roller shaft 63 is rotatably mounted. Moreover, the side walls 67A are conventionally constructed and arranged for rotatably supporting the opposed ends of the impression roller shaft 61. And, the carriage 67B lower wall is preferably connected to the housing 14 by means of a depending spring 68. Further, the base 12 includes a driven gear 61A which is suitably fixedly connected to or integrally formed with the impression roller shaft 61. Thus, the impression roller shaft 61 and drive gear 61A are both conventionally rotatably connected to the carriage 67. In addition, the base 12 includes a driven gear 63A which is suitably fixedly connected to or integrally formed with the ejection roller shaft 63. And, the base 12 includes an endless gear belt 69 which is looped about the gears 61A and 63A for transmitting rotational movement of the gear 61A to the gear 63A, whereby the ejection roller shaft 63 and the impression roller 60 are driven in timed relationship with one another. Moreover, the gears 61A and 63A, and the impression roller 60 and ejection roller 62, are relatively dimensioned for ensuring that the peripheral velocity of the ejection roller 62 is greater than the peripheral velocity of the impression roller 60, when neither of the respective rollers 60 and 62 are in engagement with a sheet 20 fed thereto. As thus constructed and arranged, when the impression roller 60 is urged downwardly, the impression roller drive shaft 61 and drive gear 61A therefor are urged downwardly as the supporting carriage 67 pivots downwardly about the ejection roller shaft 63, against the force exerted on the carriage 67 by the spring 68, to provide a variable gap between the drum 24 and impression roller 60, to accommodate mixed thickness sheets 20. And the spring 68 resiliently urges the carriage 70, and thus the impression roller 60, upwardly against any downwardly directed force exerted on the impression roller 60, by a given sheet 20 fed beneath the postage meter drum 24, for urging mixed thickness sheets 20 into printing engagement with the drum 24.

In addition, according to the invention, the base 12 (FIG. 1), and thus the mailing machine 10, includes an intermittently operable, electromechanical, drive system 70 (FIG. 2) for driving the shutter bar lever arm 40 (FIG. 1), output gear 26 and thus the postage meter drum 24, and the roller shaft 63 and thus the roller 60, preferably in timed relationship with one another, in response to movement of the trip lever 54 by a sheet 20 fed to the machine 10.

The drive system 70 (FIG. 2) is conventionally supported by the housing 14 and generally includes a drive mechanism 72 and drive system operating apparatus 74. More particularly, the drive mechanism 72 (FIG. 2) comprises a plurality of interactive structures including control structure 76, actuating structure 78, drive mechanism latching structure 80 and rotary timing cam structure 82. And, the operating apparatus 74 includes trip lever structure 84, and, in addition, comprises a plurality of components, including a trip switch 86, trip solenoid 88, motor switch 90 and d.c. motor drive system 92, and a control circuit 94 to which the components 86, 88, 90 and 92 are electrically connected.

The control structure 76 (FIG. 2) includes a control member 100 which is conventionally pivotably mounted for rotation, in a generally vertically-extending plane, on a pivot shaft 102 which is secured to or integrally formed with the housing 14. As viewed in its home position (FIG. 5), the control member 100 includes a vertically oriented, upwardly-extending, leg 104, a laterally-extending leg 106 and a depending leg 108. The upwardly-extending leg 104 acts as a cam, latch and stop, and includes a cam surface 110, latching surface 112 and a stop surface 114. The laterally-extending leg 106 acts as a cam follower and includes a cam follower surface 116. And, the depending leg 108 acts as a lever arm and includes upper and lower slots 118 and 120. The control structure 76 also includes upper and lower springs, 122 and 124. The upper spring 122 has one end located in the upper slot 118 for attachment thereof to the depending leg 108 and has the other end attached to the actuating structure 78. And, the lower spring 124 has one end located in the lower slot 120 for attachment thereof to the depending leg 108 and has the other end indirectly attached to the housing 14.

Figure 4:
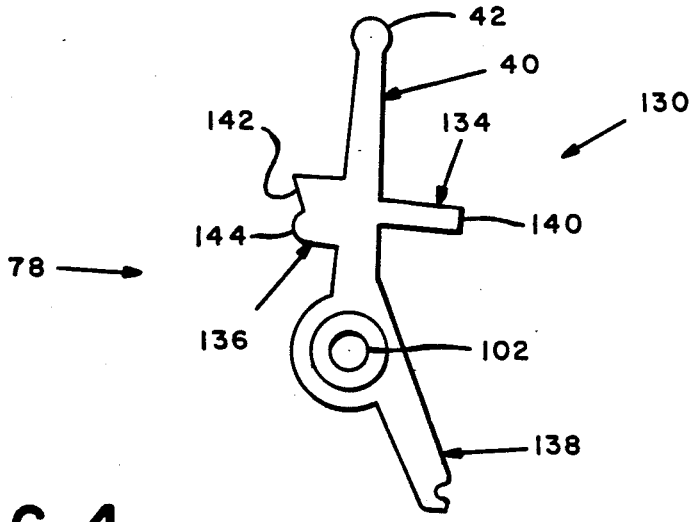
FIG. 4 is a plan view of the actuating member of the drive mechanism of FIG. 2, showing the relevant functional portions of the actuating member, including the lever arm portion thereof.

The actuating structure 78 (FIG. 2) includes an actuating member 130 which is also conventionally pivotably mounted for rotation, in a generally vertically-extending plane, on the pivot shaft 102. The actuating member 130 (FIG. 4) includes an upwardly-extending leg which acts as a lever arm and, in particular, is the shutter bar actuating lever arm 40. In addition, the actuating member 130 includes opposed legs, 134 and 136, which laterally extend from the actuating lever arm 40, and a depending leg 138. One of the laterally-extending legs 134 acts as a cam key and cam follower and is thus transversely dimensioned to act as a key and includes a cam follower surface 140. The other laterally-extending leg 136 acts as a pivot limiter and motor switch actuator, and includes a travel limiting surface 142, which is conventionally formed for contacting a housing stop 143, and a motor switch actuating shoulder 144. And, the depending leg 138 acts as a lever arm and includes a lower slot 146 in which the aforesaid other end of the control structure's upper spring 122 (FIG. 2) is located for attachment thereof to the depending leg 138.

The drive mechanism latching structure 80 (FIG. 2) includes an latching member 150 which is conventionally pivotably mounted for rotation, in a generally horizontally-extending plane, on another pivot shaft 152 which is secured to or integrally formed with the housing 14. The latching member 150 (FIG. 3) has a plurality of laterally-extending legs including one laterally-extending leg 154 which acts as a lever arm and includes a trip solenoid shaft striking surface 155. Another of the laterally-extending legs 156 acts as a leaf spring, and yet another of the laterally-extending legs 158 acts as a leaf spring flexure limiter. The leaf spring leg 156 and flexure limiting leg 158 extend substantially parallel to each other and define a longitudinally-extending slot 162 therebetween. And, still another of the laterally-extending legs 160 acts as a cam follower and latch, and includes a cam follower surface 164 and latching surface 166.

The rotary timing cam structure 82 (FIG. 2) includes a generally annularly-shaped rotary cam 180, which is suitably secured to or integrally formed with a drive shaft 82. The drive shaft 182 (FIG. 5) is conventionally connected to the housing 14, as by means of a supporting frame 183 which is conventionally removably connected to the housing 14, to permit rotation of the cam 180 in a generally vertically-extending plane. As viewed from the end of the shaft 182 which extends inwardly of the housing 14, the cam 180 has an outer, peripherally-extending cam surface 184, which tapers inwardly toward the viewing end of the drive shaft 182 to accommodate camming engagement with the control member's cam follower surface 116. The cam surface 184, when thus viewed and also when viewed as extending counter-clockwise from a line "1" (FIG. 5A) passing through the average radius of the cam surface 184, commences at a radial distance "$r_1$" from the axis of the shaft 182, spirals outwardly, and ends at a radial distance "$r_2$" from the axis of the shaft 182. As thus constructed and arranged, the cam 180 also includes a radially-extending surface 186 having an average radial width of the sum of $r_2-r_1$. Further, as thus viewed, the cam 180 has a generally annularly-shaped inwardly-facing cam surface 188, surrounding the drive shaft 182, and includes a slot 190 formed thereinto from the surface 188. The slot 190 is located vertically above the drive shaft 182, when the cam 180 is disposed in its home position, and is suitably dimensioned for receiving thereinto the actuating member's key-shaped, laterally-extending, leg 134.

The trip lever structure 84 (FIG. 2) includes a trip member 200 which is conventionally pivotably mounted for rotation, in a generally vertically-extending plane, on a pivot shaft 202 which is secured to or integrally formed with the housing 14. The trip member 200 includes an upwardly extending leg, known in the art as the trip lever 54, and a depending leg 204, which acts as a lever arm and includes a slot 206 formed therein. The trip lever 54 preferably includes an upper, laterally-extending, shoulder 208, having an arcuately-extending upper edge 210 which extends towards respective sheets 20 fed thereto for supporting and guiding such sheets 20 into the path of travel 22 when the trip lever 54 is engaged and moved by such sheets 20. In addition, the trip lever 54 includes a lower, laterally-extending trip switch actuating shoulder 212. The trip lever structure 84 further includes a spring 214, having one end located in the depending leg's slot 206 and the other end conventionally connected to the housing 14.

The trip switch 86 (FIG. 2) is preferably a single pole double throw switch having two modes of operation. The switch 86 is conventionally physically connected to the housing 14 for suitable location of the switch 86 relative to the trip lever's switch actuating shoulder 212, to allow the shoulder 212 to operate the switch 86 in response to movement of the trip lever 54. The switch 86 includes an operating lead 220 and two switch position, leads, 220A and 220B. When the switch 86 is in one of its modes of operation, the leads 220 and 220A are electrically connected, whereas when the switch 86 is in its other mode of operation, the leads 220 and 220B are electrically connected.

The trip solenoid 88 (FIG. 2) is preferably a conventional D.C. solenoid which includes a core or shaft 230. The solenoid 88 is conventionally physically connected to the housing 14 for suitably locating the shaft 230 relative to the latching member 150 to allow the shaft 230 to strike the surface 155 of the latching member 150 and pivot the latching member 150 against the force exerted thereon by the leaf spring 156, when the solenoid 88 is energized from the control circuit 94.

The motor switch 90 (FIG. 2) is preferably a single pole double throw switch having two modes of operation. The switch 90 is conventionally physically connected to the housing 14 for suitable location of the switch 90 relative to the actuating member lever arm's switch actuating shoulder 144, to allow the shoulder 144 to operate the switch 90 in response to movement of the actuating member's lever arm 40. The switch 90 includes an operating lead 236 and two switch position leads 236A and 236B. When the switch 90 is in one of its modes of operation, the leads 236 and 236A are electrically connected, whereas when the switch 90 in its other mode of operation, the leads 236 and 236B are electrically connected.

The d.c. motor drive system 92 (FIG. 2) preferably includes a conventional d.c. motor, 240 having an output shaft 242. The motor 24 is conventionally physically connected to the housing 14 via a gear box 244. The motor output shaft 242 is preferably connected, via a reduction gear train 246 within the gear box 244, to an output drive gear 248, which is suitably journalled to the gear box 244 for rotation. The drive system 92 additionally includes a timing cam drive gear 250 and gear belt 252. The cam drive gear 250 is suitably fixedly connected to or integrally formed with the cam drive shaft 182. Thus, the cam 180 is mounted for rotation with the drive gear 250. And, the gear belt 252 is endlessly looped about and disposed in meshing engagement with the drive gear 248 and cam drive gear 250. The drive system 92 further includes an ejection roller drive gear 254 and a drive shaft 256 on which the gear 254 is conventionally fixedly mounted. The drive shaft 256 is suitably rotatably connected to the housing 14 for conventionally connecting one end thereof to the ejection roller shaft 63A (FIG. 1) and disposing the ejection roller drive gear 254 (FIG. 2) in meshing engagement with the gear belt 252, between the motor output drive gear 248 and timing cam drive gear 250. Moreover, the drive system 92 additionally includes the drive system output gear 46, (FIG. 2), which is suitably fixedly connected to or integrally formed with the cam drive shaft 182 for rotation therewith and extends upwardly through the housing 14 for engagement with the drum drive gear 26 (FIG. 1). Thus, the cam 180 is mounted for rotation with the output gear 46 (FIG. 1) and drive gear 26.

The control circuit 94 (FIG. 2) preferably includes a conventional d.c. power supply 270. In addition, the control circuit 94 includes suitable trip control circuitry for interconnecting the trip switch 86, trip solenoid 88 and power supply 270 for energization of the solenoid 88 in response to operation of the switch 86. Preferably, the trip control circuitry is conventionally constructed and arranged such that in one mode of operation the switch 86 (FIGS. 9, 10 and 11) is operated to electrically connect the switch leads 220 and 220B for energizing the solenoid 88.

Figure 9:
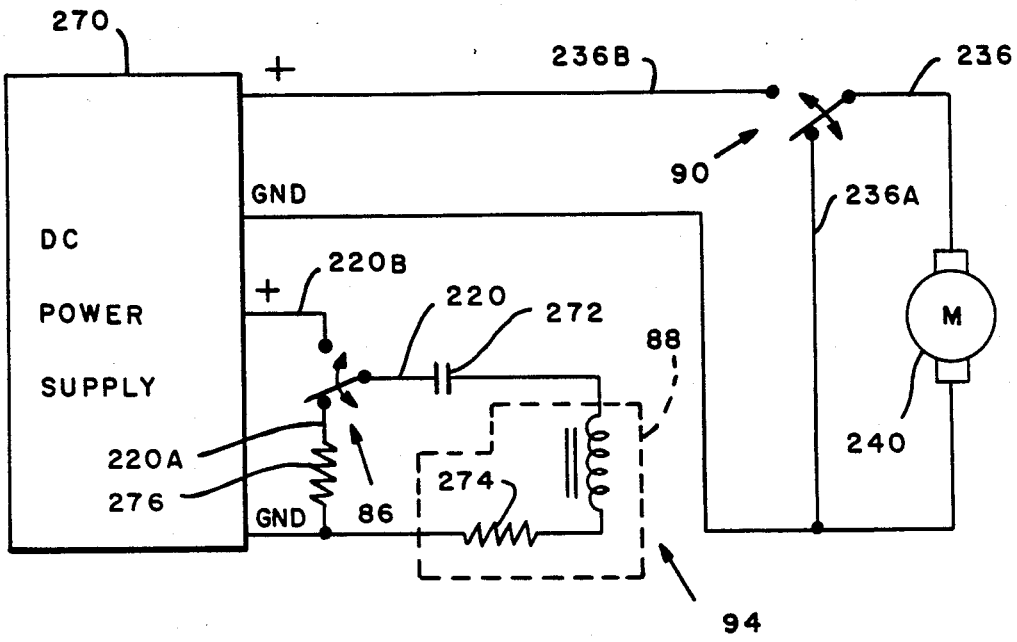
FIG. 9 is a schematic view of the control circuit of FIG. 2 showing the components thereof when the drive mechanism is in its normal or at-ready mode of operation as shown in FIGS. 5, 5A and 5B.
Figure 11:
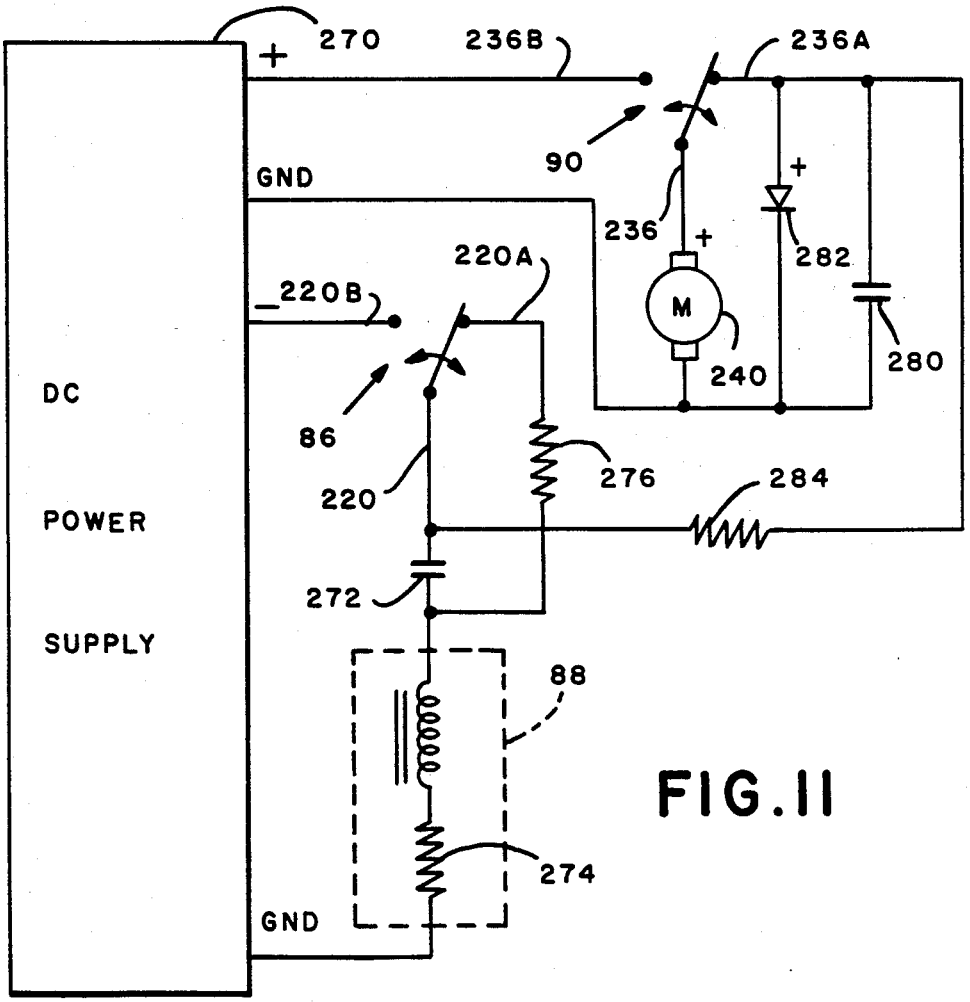
FIG. 11 is a schematic view, similar to FIG. 9, of another embodiment of FIG. 9.

In the embodiments shown in FIGS. 9 and 11, the solenoid 88 is energized through a series connected capacitor 272, from the power supply 270. Thus the solenoid 88 is operated for a time period which corresponds, substantially, to the charging time constant of the R-C circuit defined by the capacitor 272 and internal resistance 274 of the solenoid 88. In the other mode of operation the switch 86 is operated to electrically disconnect the switch leads 220 and 220B for maintaining deenergization of the solenoid 88, and to electrically connect the switch leads 220 and 220A for discharging the capacitor 272 through a series connected resistor 276. In either of the embodiments (FIGS. 9 or 11), the resistance value of the resistor 276 is preferably chosen to ensure that the capacitor 272 does not discharge sufficiently to permit the next operation of the switch 86 to energize the solenoid 88 before the completion of a single revolution of the drum drive gear 26 or cam 180. Thus the time constant of the R-C circuit defined by the capacitor 272 and resistor 276 is chosen to maintain the discharge interval of the capacitor 272 for a predetermined time period, preferably corresponding substantially to the time interval during which the drum drive gear 26 and cam 180 complete rotation thereof through a single revolution. Accordingly, the trip switch 86 is disabled from energizing the solenoid 88 for a predetermined time period after any given energization thereof. Moreover, the resistance value of the resistor 276 is preferably chosen to ensure completion of discharge of the capacitor 272 before the next operation of the switch 86 which follows completion of a single revolution of the drum drive gear 26 or cam 180, to permit commencement of the next revolution thereof substantially immediately after completion of any given single revolution thereof. Thus the solenoid circuit is in its at-ready mode of operation upon completion of any given single revolution but not during any given revolution thereof.

Figure 10:
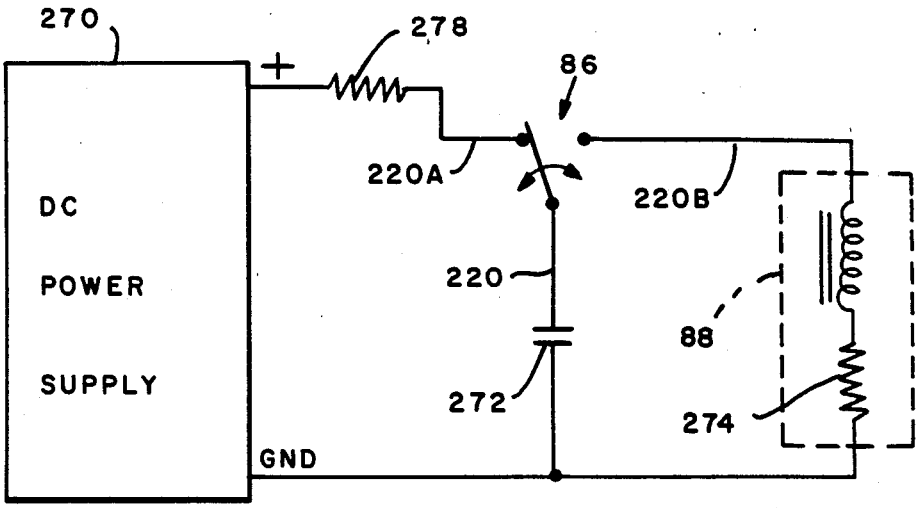
FIG. 10 is a schematic view, similar to FIG. 9, of another embodiment of the solenoid operating circuitry of FIG. 9.

The embodiment shown in FIG. 10 differs from that of FIGS. 9 and 11, in that the solenoid 88 is energized from the capacitor 272, which is connected across the solenoid 88 when the switch 88 is operated to electrically connect the switch leads 220 and 220B. Again, the solenoid 88 is operated for a time period which corresponds, substantially, to the charging time constant of the R-C circuit defined by the capacitor 272 and the internal resistance 274 of the solenoid 88. The embodiment shown in FIG. 10 also differs from that of FIGS. 9 and 10 in that in its other mode of operation the switch 86 is operated to electrically disconnect the switch leads 220 and 220B and connect the switch lead 220 and 220A for charging the capacitor 272, through a series connected resistor 278, from the power supply 270. Thus, the charging time constant of the capacitor 272 is determined by the time constant of R-C circuit defined by the capacitor 272 and resistor 278. In this embodiment (FIG. 10) the resistance value of the resistor 278 is preferably chosen to ensure that the capacitor 272 does not charge sufficiently to permit the next operation of the switch 86 to energize solenoid 88 before the completion of a single revolution of the drum drive gear 26 or cam 180. Thus the time constant of the R-C circuit defined by the capacitor 272 and resistor 278 is chosen to maintain the charging interval of the capacitor 272 for a predetermined time period corresponding substantially to the time interval during which the drum drive gear 26 and cam 180 complete rotation through a single revolution. Again, the trip switch 86 is disabled from energizing the solenoid 88 for a predetermined time period after any given energization thereof. Moreover, the resistance value of the resistor 278 is preferably chosen to ensure completion of charging of the capacitor 272 before the next operation of the switch 86 after the completion of a single revolution of the drum drive gear 26 or cam 180, to permit commencement of the next revolution thereof substantially immediately after completion of any given revolution thereof. The solenoid circuit is in its at-ready mode of operation upon completion of any given single revolution thereof but not during any given revolution thereof.

Further, the control circuit 94 (FIG. 2) includes suitable motor control circuitry for interconnecting the motor switch 90, d.c. motor 240 and power supply 270 for energization and deenergization of the d.c. motor 240 in response to operation of the switch 90. Preferably, the motor control circuitry is conventionally constructed and arranged such that in one mode of operation the switch 90 (FIGS. 9 and 11) is operated to electrically disconnect the leads 236 and 236A, for opening a shunt circuit across the d.c. motor 240, and to electrically connect the switch leads 236 and 236B, for energizing the d.c. motor 240 from the power supply 270. And, in the other mode of operation the switch 90 operated to electrically disconnect the switch leads 236 and 236B, for deenergizing the d.c. motor 240, and to electrically connect the switch leads 236 and 236A, for closing the shunt circuit across the d.c. motor 240 for dynamically braking the d.c. motor 240. In the embodiment shown in FIG. 9, the shunt circuit is a simple short circuit, whereas in the embodiment shown in FIG. 11, the shunt circuit includes a capacitor 280 and a diode connected in parallel with one another across the motor 240. When the switch 90 is in its at-ready mode of operation as shown in FIG. 11, the switch leads 236 and 236B are disconnected for disconnecting the motor 240 from the supply 270, and the switch leads 236 and 236A connected for connecting the shunt circuit 280, 282, across the motor 240. In addition, the cathode of the diode 282, the side of the capacitor 280 connected thereto and the negative terminal of the motor 240 are connected directly to the ground of the power supply 270. And, the anode of the diode 282, positive terminal of the motor 240 and other side of the capacitor 280 are also electrically connected to the ground of the power supply 270 via the series connected resistor 284, capacitor 272 and solenoid 88. When the trip switch 86 is operated to connect the switch leads 220 and 220B for energizing the solenoid 88 via the capacitor 272, the side of the capacitor 280 connected to the anode of the diode 282 is connected via the switch 86 to the negative voltage source of the power supply 270, for appropriately charging the capacitor 280 to subsequently discharge through the motor 240 for dynamically braking the motor 240. Thereafter, when the motor switch 90 is operated to disconnect the switch leads 236 and 236A and connect the switch leads 236 and 236B, the motor 240 is energized and the capacitor 280 remains charged. On the other hand, when the motor switch 90 is subsequently operated to disconnect the switch leads 236 and 236B, for deenergizing the motor 270, and to connect the switch leads 236 and 236A, for connecting the shunt circuit 280, 282 across the motor 240, the capacitor 280 discharges through the motor 240 causing current to flow in the motor 240 in the appropriate direction that is, opposite to that of the motor operating current, for dynamically braking the motor 240. Preferably, the resistance value of the resistor 284 is selected to ensure that the capacitor 280 is discharged sufficiently rapidly to avoid causing the motor 240 to rotate in the wrong direction.

Figure 2:
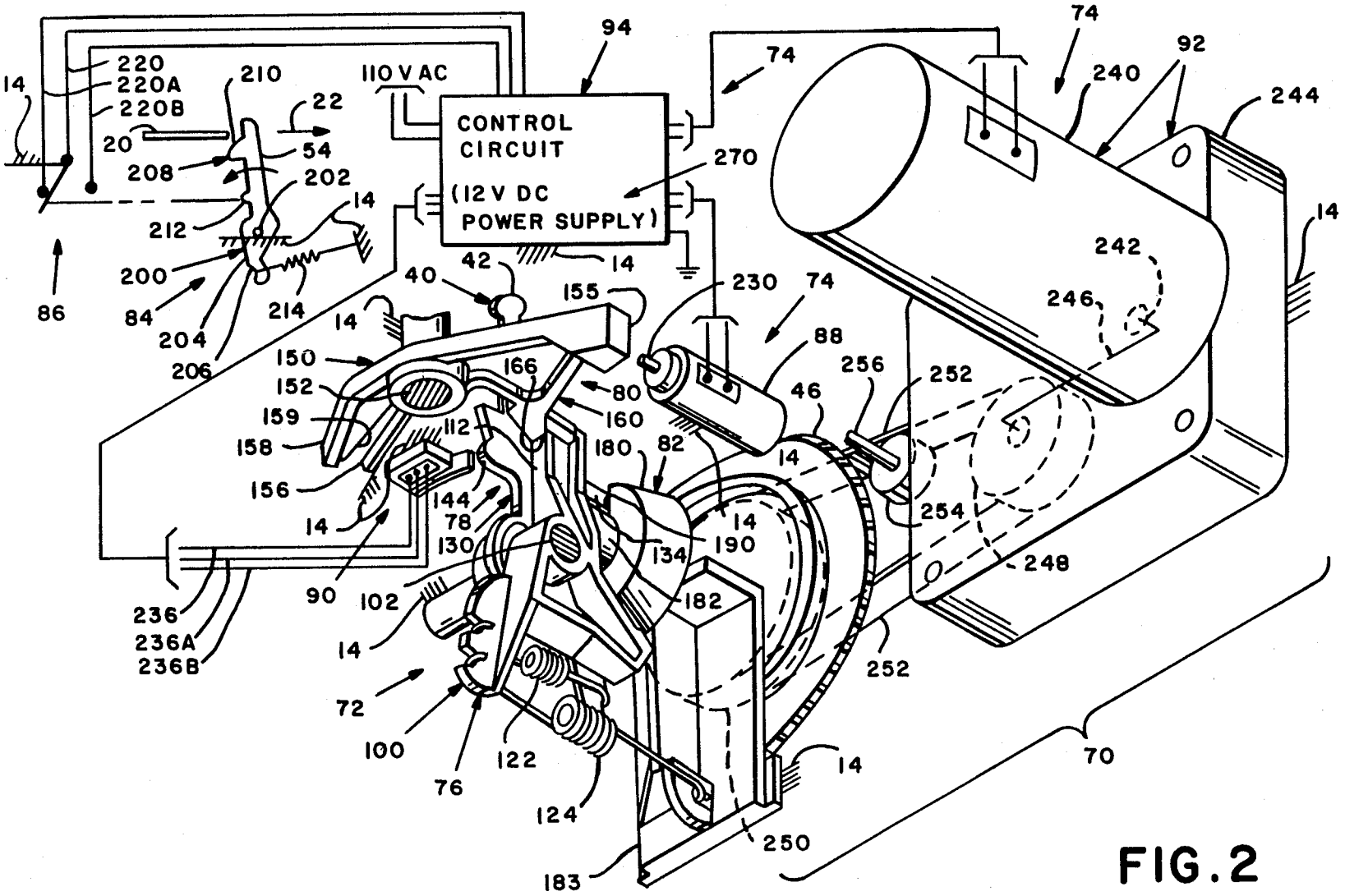
FIG. 2 is a partially schematic, perspective, view of the drive system according to the invention, including the drive mechanism and control system therefor, and relevant apparatus functionally associated therewith.
Figure 3:
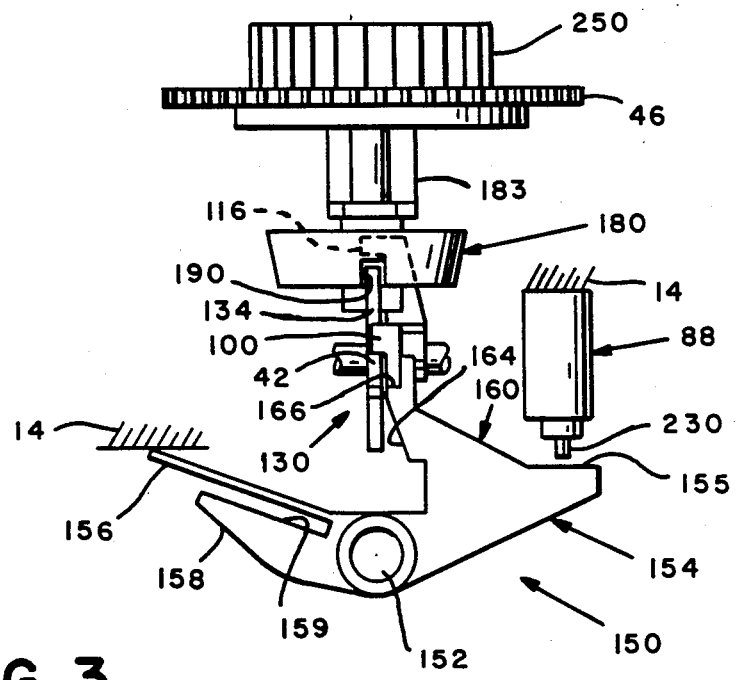
FIG. 3 is a partially schematic, top, view of the control system of FIG. 2, showing the latching member thereof and its functional interfacing relationship with the remainder of the drive mechanism.

Prior in time to operation of the mailing machine 10 (FIG. 1), the drive system 70 (FIG. 2) is in its normal or at-ready mode of operation, as shown in FIGS. 2, 3, 5, 5A and 5B. As thus shown, the trip lever 54 (FIG. 2) is held, by means of the spring 214, in engagement with trip switch 86, which acts as a travel limiting stop. Moreover, the trip lever shoulder 212 holds the switch 86 in its operating mode wherein the leads 220 and 220A are electrically connected for maintaining the trip solenoid 88 deenergized. In addition, although the spring 124 is connected for urging the control member 100 out of its home position, the control member 100 is held in its home position by the latching member 154, against rotation by the spring 124, since the latching member's latching surface 166 is held in engagement with the control member's latching surface 112 by the spring 124. When the control member 100 is thus held, the control member's cam surface 116 is located out of engagement with the cam 180. Further, the actuating member 130 (FIGS. 5 and 5A) is urged into locking relationship with the rotary cam 180, by the spring 122. And, the actuating member's lever arm 40 is held in engagement with the control member's latching surface 114 the spring 122. As thus disposed, the actuating member's lever arm 40 positions the shutter bar key portion 24 (FIG. 1) in the drum drive gear slot 30, thereby locking the drum drive gear 30 and thus the drum 24 against rotation, positions the lever arm's key leg 134 (FIGS. 5 and 5A) in the rotary cam's slot 190, thereby locking the cam 180 against rotation, positions the lever arm's stop surface 142 out of contact with the housing stop 143 and positions the motor switch actuating shoulder 144 out of engagement with the motor switch 90. When the actuating member 130 is thus held, the actuating member's cam surface 140 is located out of engagement with the cam 180. Since the latching member 154 (FIG. 3) holds the control member 100 in place against rotation by the spring 124 (FIGS. 5 and 5B), the control member 100 cannot pivot the actuating member's lever arm 40. Thus, the latching member 154 indirectly prevents actuation of the motor switch 90, holds the shutter bar lever arm's key portion 24 (FIG. 1) in the drum drive gear slot 30 and holds the lever arm's key leg 134 (FIGS. 5 and 5B) in the cam slot 90, whereby the drum 24 (FIG. 1) and cam 80 (FIGS. 5 and 5B) are locked in their respective home positions. And, the motor switch 90 (FIG. 2, is maintained in its mode of operation wherein the leads 236 and 236B (FIG. 9) are disconnected for preventing the d.c. motor 240 from being energized from the power supply 270, and wherein the leads 236 and 236A are connected for maintaining the shunt circuit across the d.c. motor 240, with the result that the d.c. motor 240 is maintained deenergized.

In operation, when a sheet 20 (FIG. 1) is fed to the base 12, the operator normally urges the sheet edge 52 into engagement with the registration fence 50 and in the direction of path of travel 22, whereby the sheet 20 is fed towards and into engagement with the trip lever 54. The force exerted by the sheet 20 (FIG. 2) against the trip lever 54 causes the trip lever 54 to rotate about the pivot shaft 202 against the force exerted by the spring 214. As the trip lever 54 rotates, the trip lever's shoulder 212 operates the trip switch 86, thereby interconnecting the switch leads 220 and 220B for energizing the solenoid 88 from the power supply 270. Whereupon the solenoid 88 (FIGS. 9, 10 and 11) is maintained energized during the time interval the capacitor 272 is being charged (FIGS. 9 and 11) or discharged (FIG. 10), as the case may be. When the solenoid 88 is energized, the solenoid's core or shaft 230 (FIG. 2) strikes the latching member's surface 155 and exerts sufficient force thereagainst, for a sufficient time period, to cause the latching member 150 to rotate about the pivot shaft 152, against the force exerted by the latching member's leaf spring leg 156, as the leg 156 is flexed against the housing 14. As the latching member 150 rotates about the shaft 152, the latching member's latching surface 166 arcuately moves out of engagement with the control member's latching surface 112 (FIG. 6), thereby releasing the control member 100 and permitting rotation thereof by the spring 124. Concurrently, the free end of the flexure limiting leg 158 bridges the slot 162 for engaging leg 156, to limit the flexure of the leaf spring leg 156. As the spring 124 rotates the control member 100, the control member 100 pivots the actuating member's lever arm 40 away from the cam 180, thereby moving the shutter bar key portion 34 (FIG. 1) out of the drum drive gear slot 30 to permit rotation of the drum drive gear 26, and thus the drum 24, moving the lever arm's key leg 134 (FIGS. 5 and 5B) out of the cam slot 190 to permit rotation of the cam 180, moving the lever arm's stop surface 142 (FIG. 2) into contact with the housing stop 143, and moving the lever arm's shoulder 144 into engagement with the motor switch 90 to actuate the switch 90.

Preferably, the capacitance value of the capacitor 272 (FIGS. 9, 10 and 11) is conventionally selected to ensure that the switch 90 is actuated before the solenoid 88 is deenergized. Thus the capacitor 272 becomes sufficiently charged (FIGS. 9 and 11) or discharged (FIG. 10), as the case may be, to cause the solenoid 88 to be deenergized after the switch 90 is actuated, although the switch leads 220 and 220B may be maintained electrically connected by the trip lever shoulder 212 (FIG. 2). Upon deenergization of the solenoid 88 the latching member 150 (FIG. 3) is rotated about the pivot shaft 152 by the leaf spring leg 156, thereby causing the latching member's cam follower surface 164 (FIG. 6B) to be urged into contact with the control member's cam surface 110. And, when the switch 90 is actuated, the switch leads 236 and 236A are electrically disconnected for removing the shunt circuit from across the d.c. motor 240, followed by the switch leads 236 and 236B being electrically connected for energizing the d.c. motor 240 from the power supply 270.

When the d.c. motor 240 (FIG. 2) is energized, the motor output shaft 242 drives the gear train 246 and thus the output drive gear 248. And, motor rotation of the drive gear 248 (FIG. 1) is transmitted by the gear belt 252 to the cam drive gear 250, ejection roller drive 254 and drive system output gear 46, for rotating, in timed relationship with one another, the rotary timing cam 180, ejection roller 62 and thus the impression roller 60, and the drum drive gear 26 and thus the postage meter drum 24.

Accordingly, rotation of the trip lever 54 (FIG. 1) by a sheet 20 fed thereto eventuates in causing the drum 24 and impression roller 60 to commence rotating in timed relationship with one another for feeding the sheet 20 downstream in the path of travel 22 beneath the drum 24 and causing the ejection roller 62 to commence rotating for feeding sheets 22 engaged thereby from beneath the idler roller 66 and thus from the machine 10. Since the angular velocity of the ejection roller rim 62A is normally greater than the angular velocity of the impression roller 60, the peripheral velocity of the ejection roller 62 is greater than that of the impression roller 60, as a result of which the ejection roller 62 tends to pull respective sheets 20 which are fed thereto from beneath drum 24 while the drum 24 and impression roller 60 are still rotating in engagement with the sheets 20. When the drag force exerted on the ejection roller rim 62A, by a sheet 20 engaged by the drum 24 and impression roller 60, exceeds the spring force exerted on the ejection roller rim 62A by the coil spring 62B, the ejection roller shaft 63 continues rotation and stores energy in the coil spring 62B as the ejection roller rim 62A slips relative to the shaft 63, until the drum 24 is no longer in engagement with the sheet 20. Whereupon, the coil spring 62B releases the energy stored therein by driving the ejection roller rim 62A for feeding the sheet 20 from the machine 10. Moreover, the ejection roller 62 feeds the sheet 20 out of engagement with the trip lever 54. Whereupon the trip lever 54 is rotated about the pivot shaft 202 (FIG. 2) by the spring 214, causing the trip lever's shoulder 212 to operate the trip switch 86 for disconnecting the switch leads 220 and 220B and connecting the switch leads 220 and 220A for returning the trip switch 86 to its at-ready mode of operation.

However, although the trip switch 86 (FIG. 2) is returned to its at-ready mode of operation, as hereinbefore discussed, the trip switch 86 is disabled from energizing the solenoid 88 for a predetermined time period after any given energization thereof. And, the time period preferably corresponds substantially to the time interval during which the cam 180 or drum drive gear 26 complete rotation thereof through a single revolution. Accordingly, if a next sheet 20 were fed to the machine 10 after return of the trip switch 86 to its at-ready mode of operation, but before completion of a single revolution of the cam 180 or drum drive gear 26, movement of the trip lever 40 by the sheet 20, sufficiently to operate the switch 86, would not result in energization of the solenoid 88. Thus the solenoid circuit is constructed and arranged to prevent the drive mechanism 72 from being double tripped during any given single cycle of operation thereof, thereby ensuring single revolution operation of the drive mechanism 72 and preventing sheets 20 from being jammed between the drum 24 (FIG. 1) and impression roller 60, and ejection roller 62 and idler roller 66.

As hereinbefore discussed, rotation of the trip lever (FIG. 1) by a sheet 20 fed thereto which does result in operation of the trip switch 86 for energizing the solenoid 88, also eventuates in causing the rotary timing cam 180 (FIG. 2) to commence rotating in timed relationship with the impression roller 60 (FIG. 1), drum 24 and ejection roller 66. When the cam 180 (FIG. 6) commences rotation, the actuating member 130 is held against the housing stop 143 due to the spring 124 having rotated the control member 100 when the control member 100 was released by the latching member !54. When the actuating member 130 is thus held by the control member 100, the actuating member's cam follower surface 140 is located in a plane which is slightly spaced apart from, and which extends substantially parallel to, the rotary cam's camming surface 188 (FIG. 6). Thus the cam follower surface 140 is not initially disposed in engagement with the cam surface 188, due to the spring 124 holding the actuating member's lever arm 40 against the stop 143. Moreover, when the cam 180 commences rotation, the control member's cam follower surface 116 is located out of engagement with the cam's peripherally-extending cam surface 184.

As the cam (FIGS. 7 and 7A) continues rotating, the cam's peripherally-extending cam surface 184 slidably engages the control member's cam follower surface 116 and, due to the cam surface 184 spiraling outwardly relative to the axis of the cam drive shaft !82, the control member 100 is gradually rotated clockwise about the pivot shaft 102 against the correspondingly gradually increasing force exerted by the spring 124. Since actuating member 130 (FIG. 2) is held against the control member 100 by the spring 122, the actuating member 130 rotates in unison with the control member 100 until the actuating member's cam follower surface (FIGS. 7 & 7A) contacts the rotating cam surface 188. Whereupon, further movement of the actuating member 130 is stopped, while the control member 100 continues to be rotated by the cam 180. As a result, continued rotation of the control member 100 is accomplished against the gradually increasing forces exerted by both the spring 122 and 124. Moreover, as the control member 100 (FIG. 7B) continues rotation after the actuating member 130 is held by the cam 180, since the latching member's cam follower surface 164 is disposed in sliding engagement with the control member's cam surface 110, the latching member 154 is gradually rotated about the pivot shaft 152 (FIG. 3) against the force exerted by the leaf spring leg 156, until the control member's latching surface 112 is rotated beyond the latching member's latching surface 166. Whereupon the leaf spring leg 156 rotates the latching member's latching surface 166 into facing relationship with the control member's latching surface 112.

Thereafter, as the cam 180 (FIG. 8) still further continues rotation, the cam's peripherally-extending cam surface 184 disengages the control member's cam follower surface 116. As a result, the control member's spring 124 urges the control member's latching surface 112 into latching engagement with the latching member's latching surface 166, thereby holding the latching member 154 (FIG. 3) against any further rotation until the solenoid 88 (FIG. 2) is re-energized. When the control member 100 (FIGS. 8A and 8B) is thus initially latched in place, the cam 180 has not yet rotated sufficiently to disengage the cam surface 188 from the actuator member's cam follower surface 140.

Accordingly, the rotating cam 180 continues to maintain the shutter bar's key portion 34 (FIG. 1) out of the drum drive gear slot 30, and continues to maintain the actuating member's key leg 134 (FIGS. 8A and 8B) out of cam slot 190, until the cam 180 rotates still further and disengages the cam follower surface 140. Whereupon, the spring 122 rotates the actuating member 130 (FIGS. 5, 5A and 5B) into engagement with the latched control member 100, thereby urging the shutter bar's key portion 24 (FIG. 1) into the drum drive gear slot 30 to prevent further rotation of the drum drive gear 26 and thus the drum 24, moving the actuating member's key leg 134 (FIGS. 5, 5A and 5B) into the cam slot 190 and concurrently urging the actuating member's shoulder 144 out of engagement with the motor switch 90 for actuating the switch 90. When the switch 90 is actuated, the switch leads 236 and 236B are electrically disconnected for deenergizing the d.c. motor 240, followed by the switch leads 236 and 236A being electrically connected to close the shunt circuit across the d.c. motor 240 for dynamically braking the d.c. motor 240. As a result, the d.c. motor 240 is both deenergized and dynamically braked as the shutter bar key portion 24 (FIG. 1) enters the drum drive gear slot 30 and the actuating member's key leg 134 (FIGS. 5, 5A and 5B) enters the cam's slot 190. And, when the spring 122 has rotated the actuating member 130 into engagement with the latched control member 100, the shutter bar key portion 24 (FIG. 1) locks the drum drive gear and thus the drum 24 in their respective home positions, and the actuating member's key leg 134 (FIGS. 5, 5A and 5B) locks the cam 180 in its home position, thereby returning the drive system 70 (FIG. 2) to its normal or at-ready mode of operation.

In accordance with the objects of the invention there has been described simplified rotary printing structure drive system, including a control circuit therefor, which ensures single cycle operation thereof. Although the invention disclosed herein has been described with reference to a simple embodiment thereof, variations and modifications may be made therein by persons skilled in the art without departing from the spirit and scope of the invention. Accordingly, it is intended that the following claims cover the disclosed invention and such variations and modifications thereof as fall within the true spirit and scope of the invention.

What is claimed is:

1. In a mailing machine including a postage meter, wherein the postage meter includes rotary printing means for printing indicia on a sheet fed to the machine, and the machine includes means for driving the printing means, wherein the driving means including a drive gear, the driving means includes a locking member movable into and out of locking engagement with the drive gear, the driving means includes an actuating member for moving the locking member, and wherein the machine includes trip means for sensing a sheet feed to the machine, an improvement comprising:

a. a source of supply of d.c. power;

b. first circuit means connected across the power supply and including a solenoid and a trip switch actuatable for energizing the solenoid;

c. second circuit means connected across the power supply and including a d.c. motor and a motor switch actuatable for energizing and deenergizing the motor;

d. the trip switch actuated in response to the trip means sensing a sheet fed to the machine, and the driving means causing the actuating member to move the locking member out of locking engagement with the drive gear and actuate the motor switch for energizing the motor to drive the drive gear when the solenoid is energized;

e. the driving means including means for preventing the actuating member from moving the locking member into locking engagement with the drive gear;

f. the driving means moving the actuating member to actuate the motor switch for deenergizing the motor and to move the locking member into locking engagement with the drive gear when the drive gear completes a single revolution; and g. the second circuit means including means for dynamically braking the motor when the motor switch is actuated for deenergizing the motor.

2. The improvement according to claim 1, wherein the dynamic braking means is a shunt circuit, the motor switch closing the shunt circuit across the motor when the motor switch is actuated for deenergizing the motor, and the motor switch opening the shunt circuit when the motor switch is actuated for energizing the motor.

3. The improvement according to claim 2, wherein the shunt circuit is a short circuit.

4. The improvement according to claim 6, wherein the capacitor is connected in series with the solenoid.

5. The improvement according to claim 4, wherein the driving means includes means for preventing the actuating member from moving the locking member into locking engagement with the drive gear.

6. In a mailing machine including a postage meter, wherein the postage meter includes rotary printing means for printing indicia on a sheet fed to the machine, and the machine includes means for driving the printing means, wherein the driving means includes a drive gear, the driving means includes a locking member movable into and out of locking engagement with the drive gear, the driving means includes an actuating member for moving the locking member, and wherein the machine includes trip means for sensing a sheet feed to the machine, an improvement comprising:

a. a source of supply of d.c. power;

b. first circuit means connected across the power supply and including a solenoid and a trip switch actuatable for energizing the solenoid;

c. second circuit means connected across the power supply and including a d.c. motor and a motor switch actuatable for energizing and deenergizing the motor;

d. the trip switch actuated in response to the trip means sensing a sheet fed to the machine, and the driving means causing the actuating member to move the locking member out of locking engagement with the drive gear and actuate the motor switch for energizing the motor to drive the drive gear when the solenoid is energized; and e. the first circuit means including timing means for maintaining energization of the solenoid for a predetermined time period, and the timing means including a capacitor and the internal resistance of the solenoid.

7. The improvement according to claim 6, wherein the driving means moves the actuating member to actuate the motor switch for deenergizing the motor and to move the locking member into locking engagement with the drive gear when the drive gear complete a single revolution.

8. The improvement according to claim 6, wherein the preventing means engages the actuating member during the predetermined time period and holds the actuating member against movement thereafter for maintaining the locking member out of locking engagement with the drive gear.

9. The improvement according to claim 8, wherein the preventing means holds the actuating member against movement during a single revolution of the drive gear and thereafter permits movement of the actuating member for actuating the motor switch to deenergize the motor and for moving the locking member into locking engagement with the drive gear.

* * * * *